United States Patent [19]

Olmstead

[11] 4,226,219

[45] Oct. 7, 1980

[54] ENGINE TIMING CIRCUIT WITH NOISE IMMUNITY

[75] Inventor: John A. Olmstead, Somerville, N.J.

[73] Assignee: RCA Corporation, New York, N.Y.

[21] Appl. No.: 955,626

[22] Filed: Oct. 30, 1978

[51] Int. Cl.[3] ..... F02P 9/00

[52] U.S. Cl. ..... 123/424; 123/428

[58] Field of Search ..... 123/117 R, 148 E, 117 D, 123/148 P, 149 F, 179 A; 307/290; 328/206

[56] References Cited

U.S. PATENT DOCUMENTS

| | | | |
|---|---|---|---|
| 3,612,912 | 10/1971 | Schwartz | 307/290 |
| 3,811,420 | 5/1974 | Vogel | 123/117 R |
| 3,816,760 | 6/1974 | Slawson et al. | 307/290 |
| 3,854,465 | 12/1974 | Adams | 123/117 R |
| 3,861,370 | 1/1975 | Howard | 123/148 E |
| 3,910,243 | 10/1975 | Gau et al. | 123/117 R |
| 3,976,043 | 8/1976 | Canup et al. | 123/148 E |
| 3,991,730 | 11/1976 | Crall | 123/117 R |
| 3,996,911 | 12/1976 | Canup | 123/148 E |
| 4,051,827 | 10/1977 | Capurka et al. | 123/148 E |
| 4,060,714 | 11/1977 | Lappington et al. | 123/148 E |
| 4,117,819 | 10/1978 | Jarrett et al. | 315/209 T |
| 4,153,019 | 5/1979 | Lauberstein et al. | 123/117 R |

FOREIGN PATENT DOCUMENTS

| | | | |
|---|---|---|---|
| 197808 | 8/1978 | Fed. Rep. of Germany | 307/290 |

OTHER PUBLICATIONS

Engineer's Notebook, Article by Phil Sherrod, Vanderbilt University Computer Center, Nashville, Tenn.

*Primary Examiner*—Charles J. Myhre
*Assistant Examiner*—Raymond A. Nelli
*Attorney, Agent, or Firm*—Samuel Cohen; Carl V. Olson

[57] ABSTRACT

An electronic timing circuit for an internal combustion engine includes a Schmitt trigger operated by timing pulses from a magnetic pick-up mounted on the engine. The upper trip point is set high when the pulses have a high amplitude due to a high engine speed, so that false triggering of the circuit by noise of lower amplitude is avoided. A lower trip point is automatically set when the pulses have a low amplitude, such as when the engine is cranked to start it.

4 Claims, 3 Drawing Figures

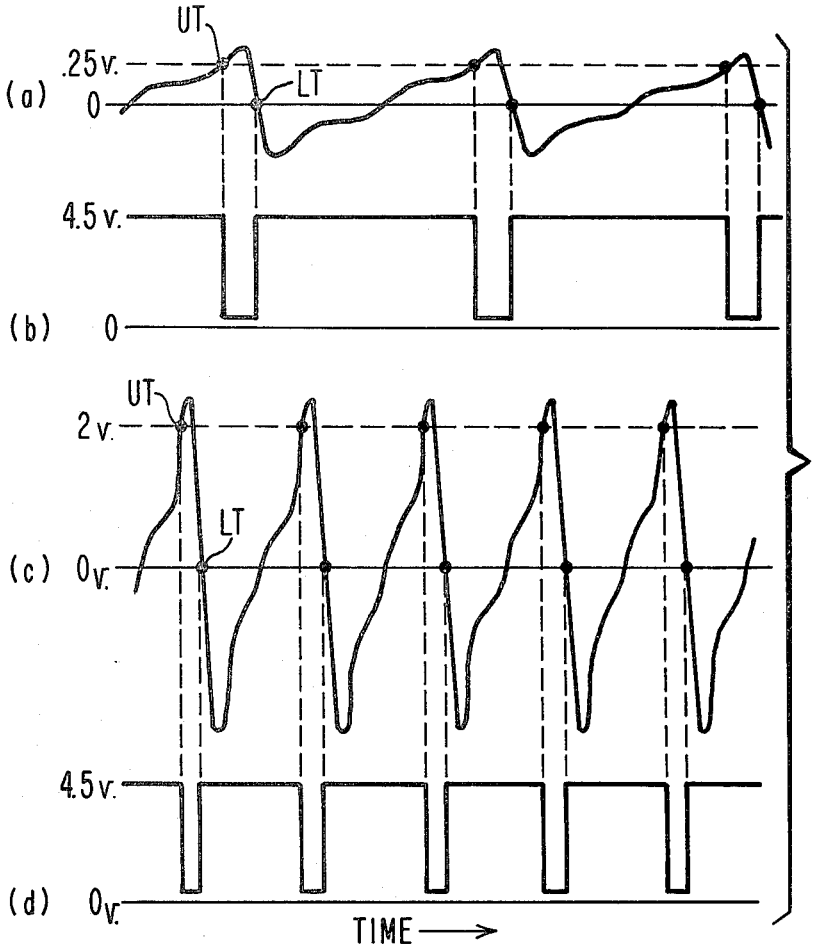
Fig. 2.
Fig. 3.
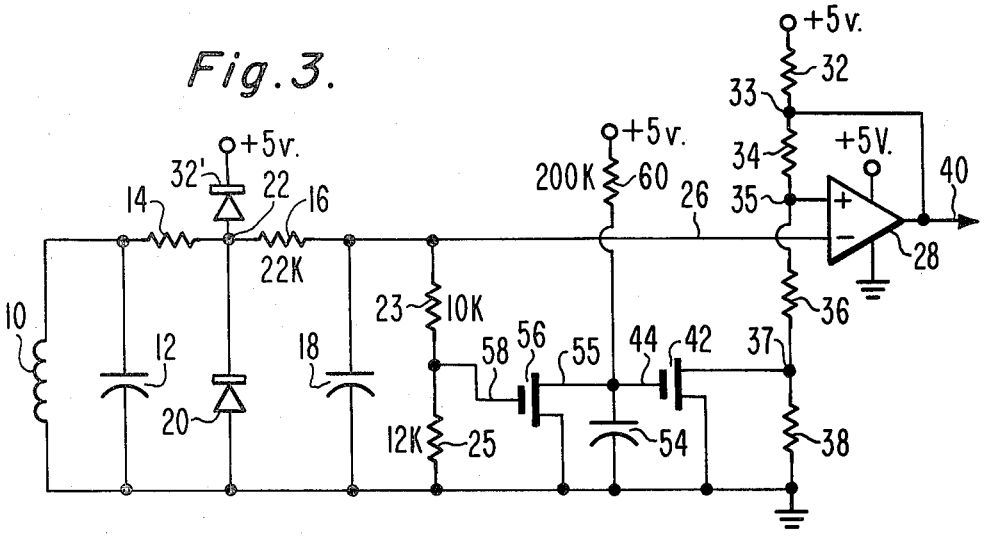

ENGINE TIMING CIRCUIT WITH NOISE IMMUNITY

This invention relates to electronic timing circuits which are useful in an automotive internal combustion engine for sensing the angular position of the engine crank shaft and providing a pulse wave for timing spark ignition and/or fuel injection.

According to an example of the invention, accurately timed pulses are generated with relative immunity to electrical noise disturbances. The noise immunity is provided by applying the signal from a magnetic pick-up to a Schmitt trigger having an upper trip point near the peak of the signal when the engine is running at idle speed or higher, and having a lower trip point when the engine is operated at a lower speed, such as when cranking the engine to start it. The high trip point used when the engine is running provides the desired noise immunity.

In the drawing

FIG. 2 is a chart of voltage waveforms which will be referred to in explaining the operation of the circuit of FIG. 1; and FIG. 3 is a diagram of an alternative timing circuit.

Figure 1:
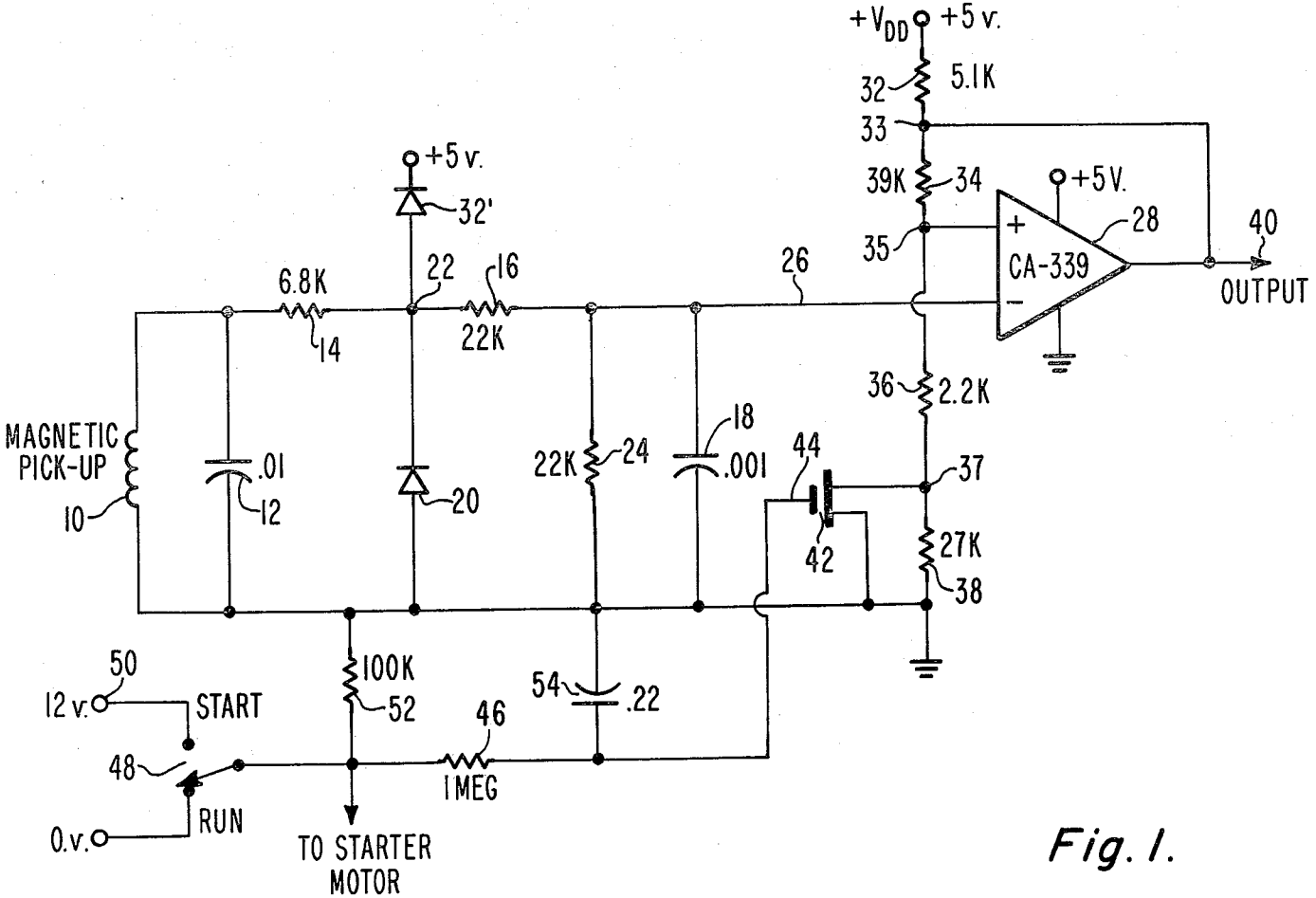
FIG. 1 is a diagram of a timing circuit constructed according to the teachings of the invention.

Referring now in greater detail to FIG. 1, a coil 10, of a variable-reluctance magnetic pick-up mounted near a rotating part of an internal combustion engine, produces an induced voltage waveform having cycles timed in a mechanically-fixed relationship with the instantaneous position of the crank shaft of the engine. A capacitor 12 shunts undesired high frequency signal components induced in coil 10. Additional rejection of high frequency signals is provided by a low-pass filter constituted by resistors 14, 16 and 24, and capacitor 18. A diode 20 is connected to prevent the voltage at junction 22 from going more negative than −0.6 volts. The resistor 24 in cooperation with resistor 16 constitute a voltage divider which provides a voltage at 26 which is one-half the voltage at 22. Accordingly, the voltage at 26 is prevented from falling below −0.3 volts. This is done to protect a voltage comparator 28 which has its inverting (−) input connected to conductor 26.

Comparator 28 may be one of four comparators in a Type CA339 Quad Voltage Comparators manufactured by RCA Corporation. The comparator may be damaged if the voltage applied to the inverting input is more negative than −0.3 volts. Further protection is provided by a diode 32' connected from junction point 22 to the +5 v. bias supply to prevent the input signal at 22 from exceeding approximately 5 volts. The voltage divider 16, 24, prevents the signal at 26 from exceeding 2.5 volts. Very high voltages (such as 60 volts) induced in pick-up coil 10 during high speed operation of the internal combustion engine are thus prevented from reaching and damaging the comparator 28.

Comparator 28 has a non-inverting (+) reference input connected to a point 35 in a voltage divider extending from the $+V_{DD}$, +5 v. bias supply terminal through resistors 32, 34, 36 and 38 to ground or point of reference potential. The output terminal 40 of the comparator 28 is connected back to point 33 between resistors 32 and 34. The comparator and the resistors are connected to form a Schmitt trigger having an upper trip point and a lower trip point.

An N-type field effect transistor (FET) 42 has source and drain electrodes connected from point 37 to ground to short out resistor 38 when a positive voltage is applied to the gate electrode 44 of the transistor through a current-limiting resistor 46 and a start switch 48 from the positive terminal 50 of a 12 volt battery. Resistor 46 and capacitor 54 constitute a low-pass RC filter designed to block high frequency components due to switch bounce and other causes. The capacitor 54 also acts to prolong the application of a control voltage to the gate electrode of FET 42 about 20 milliseconds after start switch 48 disconnects the circuit from the 12 volt terminal.

The operation of the circuit of FIG. 1 will now be described with references to the waveforms of FIG. 2. Before the engine is started, the start-run switch 48 is in the position shown, FET 42 is non-conductive, the comparator 28 is "off" with a + terminal input of about 2 volts determined by its connection to point 35 of the voltage divider 32-38.

When the starter switch 48 is put in the "start" position, FET 42 conducts and shorts resistor 38, and an input voltage waveform as shown at (a) in FIG. 2 is applied at 26 to the inverting input (−) of comparator 28. The waveform is seen to have a gradual up slope and a steep down slope. When the input voltage reaches an upper trip point UT, where it becomes more positive than the reference voltage of about 0.25 volts applied from point 35 on the voltage divider to the non-inverting input (+) of the comparator 28, the comparator is turned "on" and its output 40 falls to about 0.3 volts. This causes the voltage at point 35 to fall to about 0.015 volts.

Output 40 remains at 0.3 volts, as shown by waveform (B) of FIG. 2, until the input voltage falls below a "zero crossing" lower trip point LT. Then the input voltage becomes more negative than the reference voltage of about 0.015 (almost zero) volts applied from point 35 on the voltage divider to the non-inverting input (+) of the comparator, the comparator is turned "off," and its output 40 rises back to about 4.5 volts, and the voltage at 35 returns to about 0.25 volts. The trailing edges of the negative pulses in waveform (b) of FIG. 2 accurately represent a reference crank angle of the engine for use in controlling ignition and/or fuel injection.

The waveform (a) of FIG. 2 from the magnetic pick-up has lower voltage peaks during cranking than the voltage peaks of waveform (c) produced after the engine starts and runs at idle speed. Accordingly, the upper trip point UT is raised during idle speed, and higher speeds, to improve the noise immunity of the timing circuit. When the starter switch 48 is no longer in the "start" position, the FET 42 no longer conducts, and resistor 38 becomes a part of the voltage divider connected between +5 volts and ground. The comparator is off, its output 40 is high at about 4.6 volts taken from point 33 on the voltage divider. The reference voltage applied to the non-inverting input (+) of the comparator 28 from point 35 on the voltage divider is about 2 volts, all according to the example in which circuit elements have values as shown in FIG. 1.

When the input signal at 26 applied to the inverting input (−) of the comparator exceeds 2 volts, which is the new upper trip point UT on waveform (c) of FIG. 2, the comparator output 40 goes down to about 0.3 volts pulling point 33 on the voltage divider down to this value. Then the reference voltage at the non-inverting input of the comparator from point 35 on the voltage divider falls to a "zero crossing" lower trip point LT of about 0.12 volts. And, when the input signal falls below the lower trip point, the comparator turns off and its output 40 rises again to about 4.6 volts. The resulting negative output pulse, shown by waveform (d) in FIG. 2, has a trailing edge which accurately indicates the instantaneous position of the crank shaft of the engine for use in controlling the timing of ignition and/or fuel injection.

The noise immunity of the timing circuit results from the fact that the upper trip point UT, which must be at a low value such as 0.25 volts during cranking of the engine, is raised to a higher value such as 2.0 volts after the engine is started. When the engine is running, the Schmitt trigger including the comparator and voltage divider is not falsely triggered because the noise is not large enough, when added to the input signal, to exceed 2.0 volts. But if the upper trip point UT were kept at 0.25 volts, noise would often be large enough to cause false triggering.

False triggering by noise is particularly harmful if it occurs at a point in the cycle remote from the zero crossing of the steep down slope of the input signal. The circuit is most vulnerable to false triggering by noise when the gradual up slope of the input signal is near zero volts. Then a positive noise pulse going above the level of the upper trip point setting and then going below the zero volts lower trip point setting will be enough to produce a false output pulse. An upper trip point setting of only 0.25 volts is necessary during cranking of the engine, and if this setting is retained during running of the engine, the danger is very great that noise (which may come from the ignition system) will exceed the setting and produce false output pulses. However, by raising the upper trip point setting during running of the engine to a value such as 2 volts, which is higher than the amplitude of the noise, the circuit has a very high degree of immunity to noise.

It will be understood that the polarities of signals voltages and circuit elements can be reversed from those shown in the drawing and described in words without departing from the intended scope of the invention as claimed.

FIG. 3 shows an alternative arrangement in which the trip point of the Schmitt trigger is a low value when the engine is operated at cranking speeds, but is automatically increased to a high value when the signal from the magnetic pick-up 10 is high as the result of the engine running at an idling or higher speed. In FIG. 1, the gate 44 of the field effect transistor (FET) 42 is operated by a voltage through resistors 46 and 52 from the starter switch 48. In FIG. 3, the gate 44 of the FET 42 is operated by a voltage from the drain electrode 55 of a FET 56 having its gate electrode 58 connected to the junction point of resistors 23 and 25 (which replace resistor 24 in FIG. 1). The gate 44 of FET 42 (and the drain 55 of FET 56) are connected through a resistor 60 to the +5 volt terminal of the source of biasing potential. In other respects the circuit of FIG. 3 is the same as the circuit of FIG. 1.

In the operation of the circuit of FIG. 3, the FET 56 is normally "off," and it remains "off" during cranking of the engine because the signal voltage at 26 from magnetic pick-up 10, as divided by voltage divider 23, 25, is not high enough at the gate 58 of FET 56 to turn the FET "on". When FET 56 is "off", FET 42 is "on" because of the positive voltage applied through resistor 60 to the gate 44 of FET 42. When FET 42 is "on", resistor 38 is shorted out and a low upper trip point voltage UT of about 0.25 volts is provided at point 35 of the voltage divider.

After the engine starts, the signal voltage from the magnetic pick-up 10 increases to a value above 5 volts, which is limited to about 5 volts at point 22 by diode 32'. The signal voltage at the junction 58 between resistors 23 and 25 of the voltage divider 16, 23, 25 is then over the 1.5-volt threshold for turning FET 56 "on". When FET 56 is "on," the gate 44 of FET 42 is pulled to a voltage near ground and FET 42 is turned "off". The time constant of the circuit including capacitor 54 holds the voltage down and keeps FET 42 turned "off." Resistor 38 is then no longer shorted by FET 42 and the high upper trip point voltage UT of about 2.0 volts is provided at point 35 of the voltage divider.

From the foregoing it is seen that the circuit of FIG. 3 operates automatically, in response to the amplitude of the signal from the magnetic pick-up, to have a low upper trip point when the engine speed is low, as when the engine is being cranked, and to have a high upper trip point when the engine speed is at the idle speed or a higher speed.

According to yet another alternative construction, the FET 56 may be omitted from FIG. 3, and a signal supplied instead to the gate 44 of FET 42 from a source of a signal having a high or a low value depending on engine speed. The signal source may be an on-board automotive digital microprocessor used for controlling the operation of the engine with a view to maximizing fuel economy and minimizing the emission of polutants. Or, the signal source may be an independent electronic tachometer.

What is claimed is:

1. In an electric timing system for an internal combustion engine, a magnetic pick-up positioned on the engine to produce a signal waveform in which each cycle has a gradual up slope and steep down slope, a Schmitt trigger including a voltage divider, and including a comparator having an input receptive to said signal waveform, and having a reference input and an output connected to taps on said voltage divider, so that the Schmitt trigger produces an output pulse having a leading edge when the input signal on the up slope reaches an upper trip point and having a trailing edge when the input signal on the down slope reaches a lower trip point, a transistor having output electrodes defining a conduction path connected across a portion of said voltage divider, and means operative at low engine cranking speeds when the signal waveform cycles have a lower peak amplitude to render said transistor conductive and thereby reduce the upper trip point of said Schmitt trigger.

2. The combination of claim 1 wherein said means to reduce the upper trip point is constructed to be operative during cranking of the engine.

3. The combination of claim 1 wherein said engine has a starter switch, and said means to reduce the upper trip point is constructed to be operative in response to operation of the starter switch.

4. The combination of claim 1 wherein the means to reduce the upper trip point includes means responsive to the amplitude of said signal waveform from the magnetic pick-up to reduce the upper trip point when the amplitude is below a predetermined level.

* * * * *